United States Patent [19]

Evans

[11] 3,963,075

[45] June 15, 1976

[54] CENTRALIZER FOR ELASTOMER COATED BLAST JOINT

[76] Inventor: Orde R. Evans, P.O. Box 51303, O.C.S., Lafayette, La. 70501

[22] Filed: Mar. 27, 1975

[21] Appl. No.: 562,576

[52] U.S. Cl. ..... 166/241
[51] Int. Cl.[2] ..... E21B 17/10
[58] Field of Search ..... 166/241, 242, 243, 173, 166/176; 308/4 A

[56] References Cited

UNITED STATES PATENTS

| | | | |
|---|---|---|---|
| 2,145,336 | 1/1939 | Boyd | 166/241 UX |
| 2,813,697 | 11/1957 | Swart | 308/4 A |
| 2,944,608 | 7/1960 | Rush | 166/241 |
| 3,148,004 | 9/1964 | Hall et al. | 166/173 X |
| 3,197,262 | 7/1965 | Fairchild | 308/4 A |
| 3,397,017 | 8/1968 | Grant et al. | 308/4 A |
| 3,410,613 | 11/1968 | Kuus | 308/4 A |
| 3,709,569 | 1/1973 | Napper | 308/4 A |

*Primary Examiner*—Stephen J. Novosad
*Attorney, Agent, or Firm*—Jack W. Hayden

[57] ABSTRACT

A centralizer for an elastomer coated blast joint includes an elastomer body having a split extending longitudinally thereof with an opening extending centrally and longitudinally through the body. A plurality of circumferentially equidistant spaced, longitudinally extending projections are integrally formed on the body and extend from the elastomer body to aid in centralizing and positioning a blast joint adjacent a perforate section of a tubular member in a well bore.

A plurality of longitudinally spaced rings are molded in the body adjacent the opening with the rings split to coincide with the split in the elastomer body and include portions extending substantially at right angles to the rings with openings therethrough whereby securing means such as a screw or the like may be engaged therethrough for securing and positioning the elastomer body on the blast joint.

1 Claim, 3 Drawing Figures

CENTRALIZER FOR ELASTOMER COATED BLAST JOINT

SUMMARY OF THE INVENTION

Centralizers of various types have been provided for positioning tubular members in position in a well bore in a desired manner. Where a tubular member is positioned adjacent perforations in a well bore, it is subject to extreme erosion and wear due to the pressure of the incoming well fluids, and to overcome this suitable coatings such as elastomer, ceramic or the like may be provided on the production string tubular member within the well bore to inhibit cutting and pitting thereof by the incoming well fluids.

Similarly, centralizers associated with the production string in the production area of the well bore are subject to the same erosive effect, and the present invention provides a centralizer constructed and arranged to be positioned on the blast joint in the area of perforations of a well bore to inhibit wear thereon and to not interfere with the passage of various tools or devices between the production string and the casing for conducting well operations as may be desired.

An object of the present invention is to provide a centralizer for an elastomer coated blast joint including an elastomer body which is split longitudinally to be positioned on the blast joint, therebeing reinforcing rings positioned in the elastomer body for encircling the blast joint on which it is positioned and having portions extending at right angles relative to the reinforcing rings with openings therein whereby securing means may be positioned through the openings to hold the centralizer in position on the blast joint.

An object of the present invention is to provide a centralizer for an elastomer coated blast joint including an elastomer body which is split longitudinally to be positioned on the blast joint, therebeing reinforcing rings positioned in the elastomer body for encircling the blast joint on which it is positioned and having portions extending at right angles relative to the reinforcing rings with openings therein whereby securing means may be positioned through the openings to hold the centralizer in position on the blast joint said elastomer body including a plurality of longitudinally extending projections which are of equal distance and circumferentially spaced of the elastomer body for engaging with the adjacent surface in the well bore to centralize the blast joint and retain it in position.

An object of the present invention is to provide a centralizer for an elastomer coated blast joint including an elastomer body which is split longitudinally to be positioned on the blast joint, therebeing reinforcing rings positioned in the elastomer body for encircling the blast joint on which it is positioned and having portions extending at right angles relative to the reinforcing rings with openings therein whereby securing means may be positioned through the openings to hold the centralizer in position on the blast joint, said elastomer body including a plurality of longitudinally extending projections which are of substantially equal distance and circumferentially spaced of the elastomer body for engaging with the adjacent surface in the well bore to centralize the blast joint and retain it in position, said projections being of a suitable configuration whereby they may be readily cut off for fitting the particular size casing in the well bore in which the centralizer is to be employed.

Other objects and advantages of the present invention will become more readily apparent from a consideration of the following drawings and description.

DESCRIPTION OF THE PREFERRED EMBODIMENTS

Figure 1:
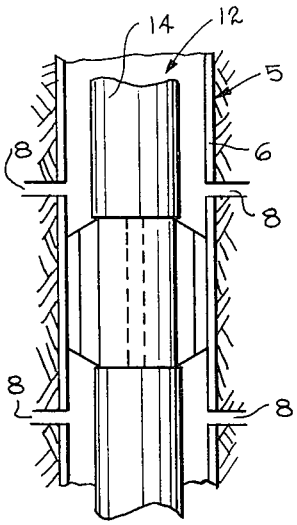
FIG. 1 is a partial vertical sectional view illustrating the present invention in position on a blast joint forming a part of the production string on a well bore and engaging the surrounding casing within the well bore in the perforated zone of the well bore.

Attention is first directed to FIG. 1 of the drawings wherein a well bore is illustrated generally by the numeral 5 and is shown as being provided with a casing 6 therein. A plurality of perforations represented at 8 communicate the producing formation in the well bore with the interior of the casing 6 for subsequent communication to the production string in a manner well known in the art.

The production string is represented generally by the numeral 12 and includes a plurality of tubular members which are engaged in end to end relation and extend to the earth's surface for conducting the production from the formation through the perforations 8 and production string 12 to the earth's surface.

The production string 12 adjacent the perforations 8 is provided with an elastomer coating 14, and such tubular members may be protected by an elastomer coating within the perforated zone of a well bore are generally referred to as blast joints.

It is desirable to maintain the blast joints and the production string generally centrally located of the well bore and to inhibit its moving towards the perforations 8 which might increase wear or other deleterious effects thereon by reason of the producing fluid moving through the perforations 8 and contacting the outer surface of the blast joints of the production string.

Figure 2:
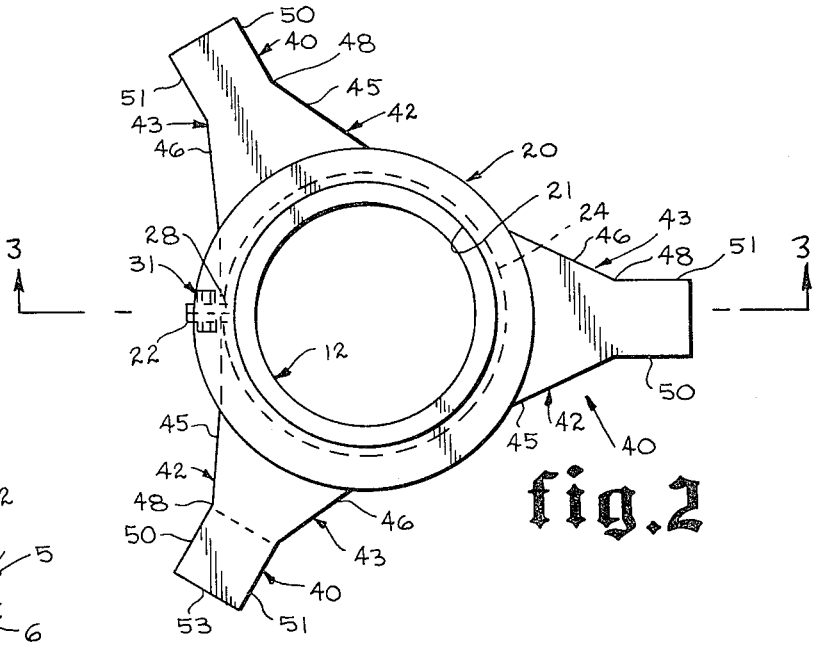
FIG. 2 is a top plan view of the centralizer of the present invention showing it in position on a blast joint forming a portion of the production string on an oil, gas or similar type well.
Figure 3:
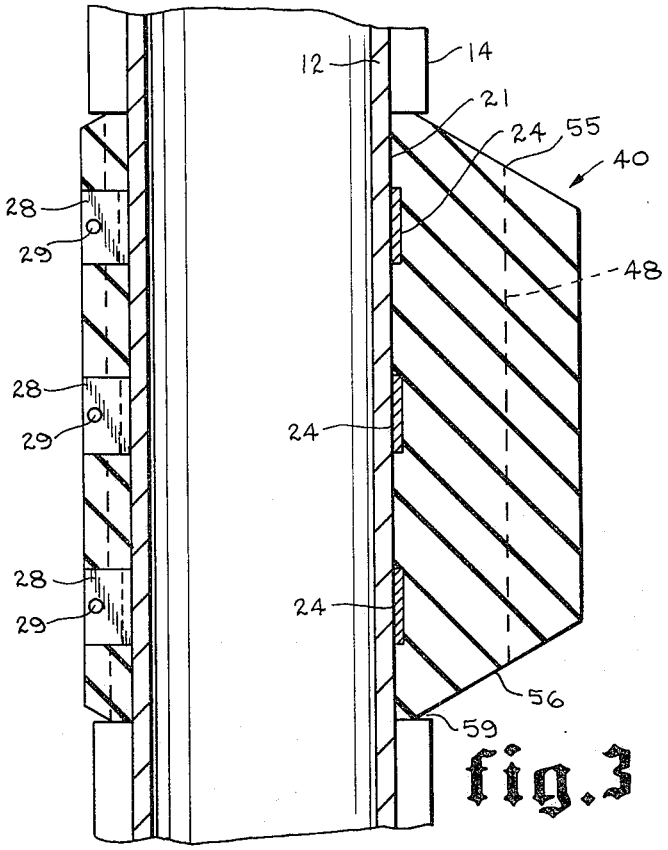
FIG. 3 is a sectional view on the line 3—3 of FIG. 2 to illustrate further structural details of the present invention.

In FIGS. 2 and 3 a centralizer comprising an elastomer body referred to generally at 20 is provided with a central opening 21 extending longitudinally therethrough. The body is split as represented at 22 longitudinally such split communicating with the opening 21 to enable the centralizer to be more readily positioned on the blast joint. The body 20 is also provided with a plurality of reinforcing rings 24 formed of metal or other suitable reinforcing material which rings are spaced longitudinally of the body 20 and adjacent opening 21 so as to be immediately adjacent the blast joints 12 forming part of the production string. The rings 24 are each provided with a pair of portions 28 which extend at substantially right angles relative to the rings 24 and project outwardly therefrom to coincide with the longitudinal split 22 in the elastomer body 20. They also each include an opening 29 to provide a means whereby a bolt and nut or other suitable securing means as represented generally at 31 may be secured therethrough to lock the stabilizer in position on the blast joint. The portions 28 are also coated with elastomer to protect them as illustrated in the drawings.

A plurality of projections 40 are provided on the body, such projections 40 extending longitudinally of the body as shown in FIG. 3 of the drawings, and preferably as illustrated in the drawings three of such projections are employed which are spaced equal distance circumferentially about the elastomer body 20.

Each of the projections 40 include side surfaces 42 and 43, each of such side surfaces 42 and 43 including a first portion 45 and 46 respectively which extends outwardly at an angle from the elastomer body 22. The first portions 45, 46 are thicker adjacent the body 20 and taper outwardly therefrom. As shown in the drawings, such first portions 45 and 46 thus converge towards each other to a predetermined point as represented at 48 and then include a continuous additional or second portion 50 and 51 which extends outwardly from the point 48 to terminate in the end 53.

The additional portions 50 and 51 are substantially parallel to each other and extend substantially perpendicularly to the elastomer body 20.

It can be appreciated that the elastomer body 20 is integral including the projections 40 thereon as well as the reinforcing rings 24 which are embedded therein.

In addition, the projections 40 are tapered as shown in FIG. 3 so as to be inclined downwardly as illustrated at 55 from their upper end or edge and are inclined upwardly from their lower end as represented by the numeral 56.

In use of the present invention, it is generally necessary to groove the elastomer coated blast joint forming part of the production string 12 as illustrated in FIG. 3 by the numeral 59 to receive the centralizer of the present invention on such blast joint. The depth of the annular recess 59 on the elastomer coating 14 will vary depending upon the size of production string, such depth being of a size so that when the centralizer of the present invention is positioned on the blast joint, it will assume the relationship to the casing 6 as illustrated in FIG. 1 of the drawings.

In some instances, the size of the production string will necessitate that the width or extent of the projections 40 be shortened and when this occurs the surfaces 50 and 51 may be cut back by any suitable means at least to the point 48 or further if necessary so that a centralizer can be provided to function for various size production strings and various size of casing in which the device is to be positioned within the well bore.

Since the centralizer is formed of an elastomer of any suitable type, such as polyurethane or the like, it will resist the jetting action of fluid flowing through the perforation 8 and thus resist cutting thereof by such fluid passage. At the same time, however, the projections 40, are spaced so that various well tools, as may be desired, may be passed downwardly between the projections and between the production string 12 and the well bore casing 6 to accomplish desired operations within the well bore.

The foregoing disclosure and description of the invention are illustrative and explanatory thereof, and various changes in the size, shape, and materials as well as in the details of the illustrated construction may be made without departing from the spirit of the invention.

What is claimed is:

1. A centralizer for an elastomer coated blast joint including:

a. an elastomer body having a split extending longitudinally thereof and an opening extending longitudinally through said body with which the split communicates;

b. a plurality of longitudinally spaced rings molded in said body adjacent said longitudinal opening, said rings being split to coincide with the split in said elastomer body and having portions extending substantially at right angles to said rings at said split with an opening therethrough whereby said elastomer body may be closed and positioned on a blast joint;

c. said elastomer body having three projections extending longitudinally of said body in circumferentially equidistant spaced relationship; and d. each of said projections having a pair of longitudinally extending side surfaces with each side surface including a first portion extending at an angle from said body to a predetermined point and an additional portion extending parallel from the termination of each of the first portions and in planes perpendicular to said body.

* * * * *